US007502585B2

(12) United States Patent
Uehara et al.

(10) Patent No.: US 7,502,585 B2
(45) Date of Patent: Mar. 10, 2009

(54) FIXING DEVICE WITH ELLIPTICALLY-SHAPED BELT MEMBER AND IMAGE FORMING APPARATUS USING THE SAME

(75) Inventors: Yasuhiro Uehara, Kanagawa (JP); Shigehiko Haseba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/208,891

(22) Filed: Aug. 23, 2005

(65) Prior Publication Data

US 2006/0177251 A1 Aug. 10, 2006

(30) Foreign Application Priority Data

Feb. 10, 2005 (JP) ..... P.2005-034700

(51) Int. Cl.
*G03G 15/20* (2006.01)

(52) U.S. Cl. ..... 399/329

(58) Field of Classification Search ..... 399/329, 399/328; 219/216

See application file for complete search history.

(56) References Cited

U.S. PATENT DOCUMENTS

| | | | | |
|---|---|---|---|---|
| 5,262,834 | A * | 11/1993 | Kusaka et al. | 399/329 |
| 5,309,209 | A * | 5/1994 | Huh | 399/69 |
| 5,525,775 | A * | 6/1996 | Setoriyama et al. | 219/216 |
| 6,649,874 | B2 * | 11/2003 | Eskey | 219/216 |
| 2003/0042240 | A1 * | 3/2003 | Natshuhara et al. | 219/216 |
| 2004/0184851 | A1 * | 9/2004 | Otsuka et al. | 399/329 |
| 2005/0265758 | A1 * | 12/2005 | Haseba et al. | 399/329 |

FOREIGN PATENT DOCUMENTS

| | | | |
|---|---|---|---|
| JP | 61093476 | A * | 5/1986 |
| JP | 04309984 | A * | 11/1992 |
| JP | 05303294 | A * | 11/1993 |
| JP | 7-140817 | | 6/1995 |
| JP | 11316507 | A * | 11/1999 |
| JP | 2000347529 | A * | 12/2000 |
| JP | 2002-108119 | | 4/2002 |
| JP | 2002108119 | A * | 4/2002 |
| JP | 2003-217816 | | 7/2003 |
| JP | 2003-223064 | | 8/2003 |
| JP | 2004-037764 | | 2/2004 |
| JP | 2004054072 | A * | 2/2004 |
| JP | 2004184446 | A * | 7/2004 |
| JP | 2004184607 | A * | 7/2004 |
| JP | 2006235462 | A * | 9/2006 |

OTHER PUBLICATIONS

Computer translation of Tsukamoto et al. (JP07-140817a).*

* cited by examiner

*Primary Examiner*—Quana M Grainger
(74) *Attorney, Agent, or Firm*—Morgan. Lewis & Bockius LLP

(57) ABSTRACT

A fixing device for fixing a toner image carried on a recording material, including: a belt member that rotates in a state where its major axis is set in a transporting direction of the recording material and its minor axis is set in a direction orthogonal to the transporting direction of the recording material; and a pressing member disposed in pressure contact with a surface of the belt member intersecting a direction of the minor axis of the belt member to form a nip part through which the recording material passes.

11 Claims, 5 Drawing Sheets

FIXING DEVICE WITH ELLIPTICALLY-SHAPED BELT MEMBER AND IMAGE FORMING APPARATUS USING THE SAME

BACKGROUND OF THE INVENTION

1. Field of the Invention

The present invention relates to fixing devices which fix a toner image on a recording material in image forming apparatuses using, for example, an electrophotographic method.

2. Background Art

In image forming apparatuses, such as copying machines and printers, which use an electrophotographic method, a photosensitive body (photosensitive drum) formed in the shape of, for example, a drum is uniformly charged and the photosensitive drum is scanned and exposed with light controlled on the basis of image information so that an electrostatic latent image is formed on the photosensitive drum. The electrostatic latent image is then turned into a visual image (toner image) with toner. Then, the toner image is directly transferred to a recording material from the photosensitive drum, or the toner image is primarily transferred to an intermediate transfer medium and secondary transferred to a recording material from the intermediate transfer medium. Thereafter, the toner image is fixed on the recording material by a fixing device.

The fixing device used for such image forming apparatuses is composed of, for example, a fixing roller in which a heating source is disposed within a cylindrical core bar, and which is formed such that a heat-resistant elastic layer and a release layer on an outer peripheral surface of the elastic layer are laminated on the core bar; and a pressing roller which is disposed in pressure contact with the fixing roller parallel thereto and formed such that a heat-resistant elastic layer, and a release layer, made of a heat-resistant resin film or a heat-resistant rubber film, on an outer peripheral surface of the elastic layer are laminated on a core bar. Also, a recording material having an unfixed toner image carried thereon is caused to pass between the fixing roller and the pressing roller so that heating and pressing is performed on the unfixed toner image, thereby fixing the toner image on the recording material. Such a fixing device is called a two-roller fixing method and it has generally been widely used.

Meanwhile, in such a conventional fixing device using fixing rollers like the two-roller fixing method, the fixing rollers have their own large heat capacity. Therefore, there is a problem in that even when supply of power to the fixing devices is started simultaneously when a power source of the image forming apparatus is turned on, considerable time is required until the fixing rollers rise in temperature from room temperature to a fixable temperature (warm-up). Because of the characteristics of the fixing rollers that quick start is difficult as such, when the image forming apparatus is in a standby state, it is also necessary to keep the temperature of the fixing rollers always constant to prepare for the start of the image forming apparatus. Therefore, there is also a problem in that electric power consumption of the fixing device is large.

In order to solve such problems, fixing devices using an endless fixing belt member have been developed instead of the configuration using the fixing roller. Since the fixing belt member has its base member made of a film-like heat-resistant resin or the like, it has advantages in that the heat capacity is small and the warm-up can be performed in a short time, as compared to a roller-shaped member such as the fixing rollers. Moreover, since the quick start is easy, the electric power consumption of an image forming apparatus in a standby state can also be reduced.

As an example of conventional techniques related to the fixing devices using the fixing belt member, the following technique is suggested (for example, see JP-A-2003-223064). According to this technique, the fixing device is configured such that The fixing device also is composed of a heating film (fixing belt member) which has a halogen heater disposed in an inner space and is rotatably supported by a support member, and a pressing roller member disposed in pressure contact with the heating film to form a fixing nip part so as to drive the heating film so that the heating film follows the pressing roller member. Infrared rays emitted from the halogen heater are converged on the fixing nip part to heat the heating film in the fixing nip part, thereby fixing a toner image on a recording material passing through the fixing nip part on demand.

Meanwhile, even in the fixing device using the above-described fixing belt member, the market needs to further shorten the warm-up time have been increasing. In order to meet such needs, it is necessary to further reduce the heat capacity of the fixing belt member. For this purpose, it is also necessary to reduce the diameter of the fixing belt member.

However, if the diameter of the fixing belt member is made small, the width of the nip part which applies heat to a recording paper never fails to become small in terms of its structure. Therefore, it is difficult to supply the amount of heat enough to melt a toner image to a recording paper while the recording paper passes through the nip part for a slight time. As a result, there is a problem in that the processing speed must be reduced due to the requirements for ensuring the amount of heat in the nip part, and thus it is difficult to shorten the warm-up time in high-speed image forming apparatuses.

SUMMARY OF THE INVENTION

The invention has been made to address the above problems. According to an aspect of the invention, a fixing device for fixing a toner image carried on a recording material includes a belt member that rotates in a state where its major axis is set in a transporting direction of the recording material and its minor axis is set in a direction orthogonal to the transporting direction of the recording material; and a pressing member disposed in pressure contact with a surface of the belt member intersecting a direction of the minor axis of the belt member to form a nip part through which the recording material passes.

BRIEF DESCRIPTION OF THE DRAWINGS

The present invention will become more fully apparent from the following detailed description taken with the accompanying drawings in which.

DETAILED DESCRIPTION OF THE INVENTION

Hereinafter, embodiments of the invention will be described in detail with reference to the accompanying drawings.

Embodiment 1

Figure 1:
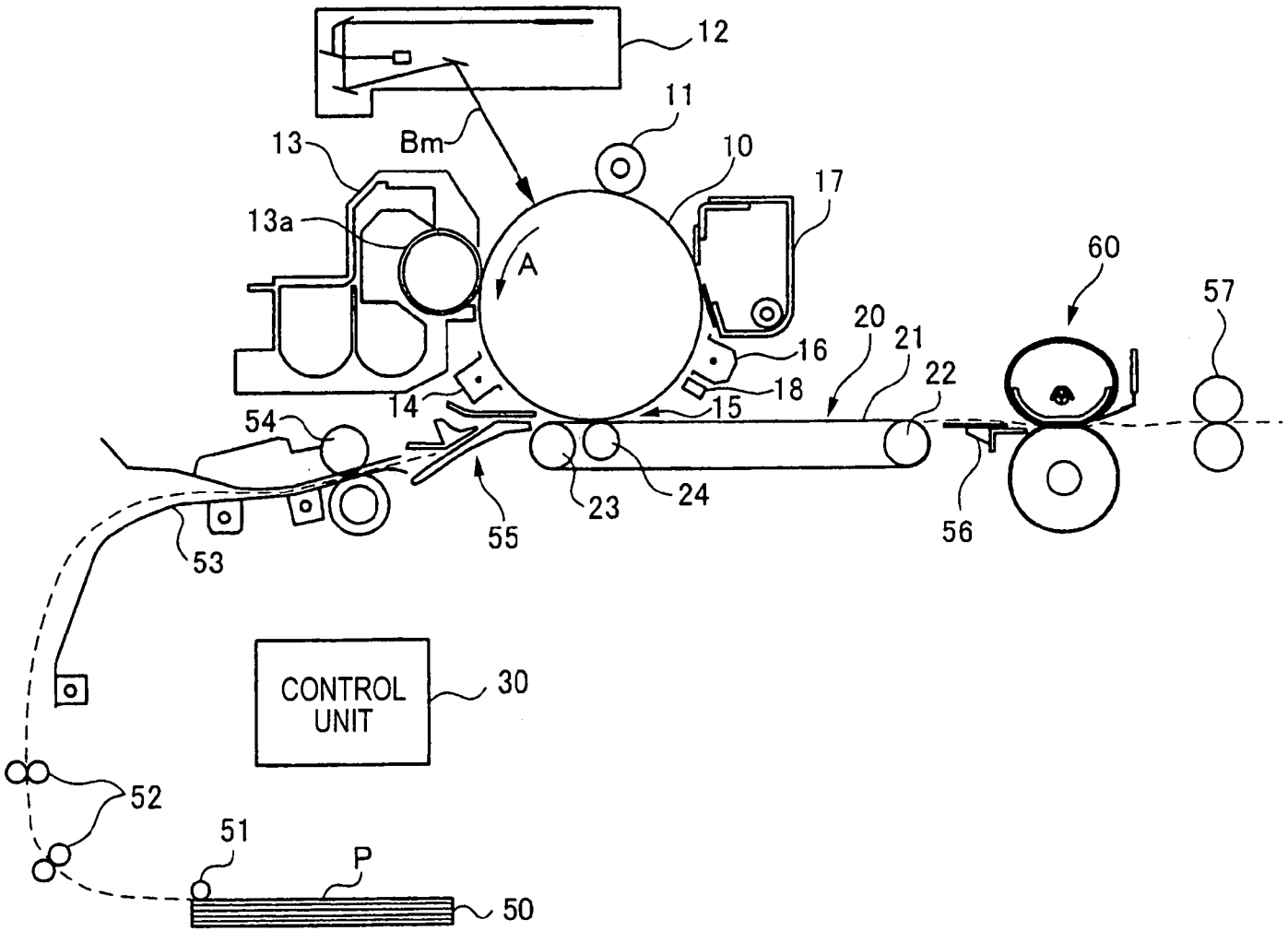
FIG. 1 is a schematic diagram showing the configuration of an image forming apparatus of the invention.

FIG. 1 is a schematic diagram showing a configuration of an image forming apparatus to which the invention is applied. The image forming apparatus shown in FIG. 1 includes electrophotographic devices, such as a charger 11 which charges a photosensitive drum 10, a laser exposing device 12 (in the drawing, an exposure beam is indicated by the symbol Bm) which writes an electrostatic latent image onto the photosensitive drum 10, a developing device 13 which contains toner and visualizes the electrostatic latent image on the photosensitive drum 10 with the toner, a charging device 14 before transfer which charges a toner image on the photosensitive drum 10 prior to electrostatic transfer in a transfer part 15, a transfer unit 20 which transfers the toner image formed on the photosensitive drum 10 onto a recording paper P as a recording material in the transfer part 15, an image density sensor 18 disposed close to the photosensitive drum 10 downstream of the transfer part 15 for performing adjustment of image density, a charging device 16 before cleaning which reduces the charged amount of a residual toner after the electrostatic transfer, and a drum cleaner 17 to remove the residual toner on the photosensitive drum 10, all of which are arranged round the photosensitive drum 10 as an example of a toner image carrier which rotates in the direction indicated by the arrow A. The image forming apparatus further includes a fixing device 60 which fixes an unfixed toner image transferred onto a paper P, and a control unit 30 which controls operation of the respective devices (respective parts or units).

Here, the transfer unit 20 includes a transfer transporting belt 21 which is stretched by a driving roller 22 and an idling roller 23, and a transfer roller 24 which is disposed inside the transfer transporting belt 21 and brought into pressure contact with the photosensitive drum 10 with the transfer transporting belt 21 therebetween. The transfer unit 20 also has a function of transferring a toner image on the photosensitive drum 10 to a paper P transported to the transfer part 15, and a function of transporting the paper P, to which the toner image has been transferred in the transfer part 15, to the fixing device 60.

Further, the image forming apparatus of the present embodiment includes, as a paper transporting system, a paper tray 50 which receives papers P (stacked in the paper tray 50), a pickup roller 51 which takes out and transports the papers P stacked on the paper tray 50 with a predetermined timing, a transporting roller 52 which transports a paper P paid out by the pickup roller 51, a registration roller 54 which feeds the transported paper P to the transfer part 15 with a predetermined timing, a transporting chute which guides the paper P transported by the transporting roller 52 to the registration roller 54, an inlet chute 55 which guides the paper P fed from the registration roller 54 to the transfer part 15, a fixation inlet guide 56 which guides the paper P having a toner image transferred thereto by the transfer unit 20 and transported therefrom to the fixing device 60, and a paper discharge roller 57 which transports the paper discharged from the fixing device 60 to a discharged paper placing part (not shown).

Next, the basic image forming process of the image forming apparatus according the present embodiment will be described. In the image forming apparatus shown in FIG. 1, image data from an image input terminal (IIT) (not shown), a personal computer (PC) (not shown), etc. is subjected to predetermined image processing by an image processing unit (not shown). In this image processing unit, predetermined image processing such as shading correction, positional deviation correction, gamma correction, various kinds of movement editing such as frame deleting editing and movement editing, etc. is performed on input reflectance data. Then, the image data subjected to the image processing by the image processing unit is output to the laser exposing device 12.

When image forming operation is started in the image forming apparatus, the photosensitive drum 10 begins to rotate. At the same time, the surface of the photosensitive drum 10 is charged to a predetermined charged potential by the charging device 11 composed of a roller member formed by coating, for example, a metal such as stainless or aluminum with a high-resistance material. Also, the laser exposing device 12 irradiates the surface of the photosensitive drum 10 while scanning it with a laser beam Bm emitted from a semiconductor laser device with use of a polygon mirror according to image data input from the image processing unit, thereby forming an electrostatic latent image on the photosensitive drum 10.

The formed electrostatic latent image is developed into a toner image with a black toner by the developing device 13. That is, a development bias composed of a direct-current voltage from a power source (not shown) or a development bias in which a direct-current voltage is superposed on an alternating voltage is applied to a developer carrier (developing sleeve) 13*a* which carries, for example, a developer having a black toner and carrier, thereby forming a developing electric field between the developer carrier and the photosensitive drum 10. Thereby the black toner on the developing sleeve 13*a* is transferred to an image part of the electrostatic latent image, and the electrostatic latent image is turned into a visual image.

Here, in the image forming apparatus of the present embodiment, a setup cycle is executed in every predetermined cycle. Specifically, before the actual image forming operation, a predetermined patch area is developed under predetermined conditions. At this time, the transfer transporting belt 21 of the transfer unit 20 is set to a state where it is spaced from the photosensitive drum 10. In this state, the developed patch area passes through the transfer part 15 as it is, and the density of a toner image in the patch area is measured by the image density sensor 18 disposed downstream of the transfer part 15. Toner density signals measured by the image density sensor 18 are sent to the control unit 30. Then, the charged potential of the photosensitive drum 10 by the charging device 11 and/or the value of the development bias applied to developing device 13 is adjusted by instructions from the control unit 30 on the basis of signals from the image density sensor 18 whereby the predetermined image density is maintained.

Next, during a normal image forming operation, a toner image formed on the photosensitive drum 10 is transported to the transfer part 15 where the photosensitive drum 10 abuts on the transfer unit 20. In this case, the transfer transporting belt 21 of the transfer unit 20 is set to a state where it abuts on the photosensitive drum 10 in advance. When the toner image is transported to the transfer part 15, in the paper transporting system, the pickup roller 51 rotates in conformity with a period of time when the toner image is transported to the transfer part 15, and a predetermined size of paper P is supplied from the paper tray 50. The paper P supplied by the pickup roller 51 is transported by the transporting roller 52, and reaches the registration roller 54 via a transporting chute 53. In the registration roller 54, the paper P is stopped once, and the registration roller 54 rotates in conformity with a movement timing of the photosensitive drum 10 on which a toner image is carried. Thereby the position of the paper P is aligned with the position of the toner image, and the paper P is delivered to the transfer part 15 from the inlet chute 55.

In the transfer part 15, the paper P which has been transported with a predetermined timing is interposed between the photosensitive drum 10 and the transfer roller 24 with the transfer transporting belt 21 of the transfer unit 20 therebetween. At this time, since a voltage (transfer bias) having reverse polarity to charged polarity (called negative polarity herein) of toner is applied to the transfer roller 24, charges of reverse polarity to the charged polarity of the toner on the photosensitive drum 10 is imparted from the transfer roller 24 to the transfer transporting belt 21. Thereby, an unfixed toner image carried on the photosensitive drum 10 is electrostatically transferred onto a paper P at the transfer part 15 where the toner image is pushed by the photosensitive drum 10 and the transfer roller 24.

The paper P having the toner image electrostatically transferred thereon is peeled off from the photosensitive drum 10 and transported while being electrostatically attracted to the transfer transporting belt 21 of the transfer unit 20, and is delivered to the fixing device 60 provided downstream of the transfer unit 20 in the transporting direction of the paper P. Incidentally, if the paper P is not peeled off from the photosensitive drum 10, but is left attracted to the photosensitive drum 10, the paper P is separated from the photosensitive drum 10 by a separating claw (not shown) disposed in the vicinity of the surface of the photosensitive drum 10 downstream of the transfer part 15, and electrostatically attracted to the transfer transporting belt 21.

In a rear end of the transfer transporting belt 21, which transports the paper P, at the fixing device 60, the paper P is peeled off from the transfer transporting belt 21 by the curvature of the transfer transporting belt 21 when the belt is wound around the driving roller 22, and by the stiffness of the paper P itself. Then, the paper P is guided by the fixation inlet guide 56, and transported to the fixing device 60.

The unfixed toner on the paper P transported to the fixing device 60 is subjected to fixing processing by heat and pressure in the fixing device 60 to be fixed on the paper P. Then the paper P which has passed through the fixing device 60 is transported to the discharged paper placing part (not shown) provided in a discharge part of the image forming apparatus by the paper discharge roller 57, thereby completing a series of image forming operations.

Incidentally, although the image forming apparatus of the present embodiment is adapted to form a monochromatic (black) toner image, the invention can be applied to, for example, a color image forming apparatus which superimposes yellow, magenta, cyan, and black toner images on each other to forms a color image.

Subsequently, the fixing device 60 disposed in the image forming apparatus of the present embodiment will be described.

Figure 2:
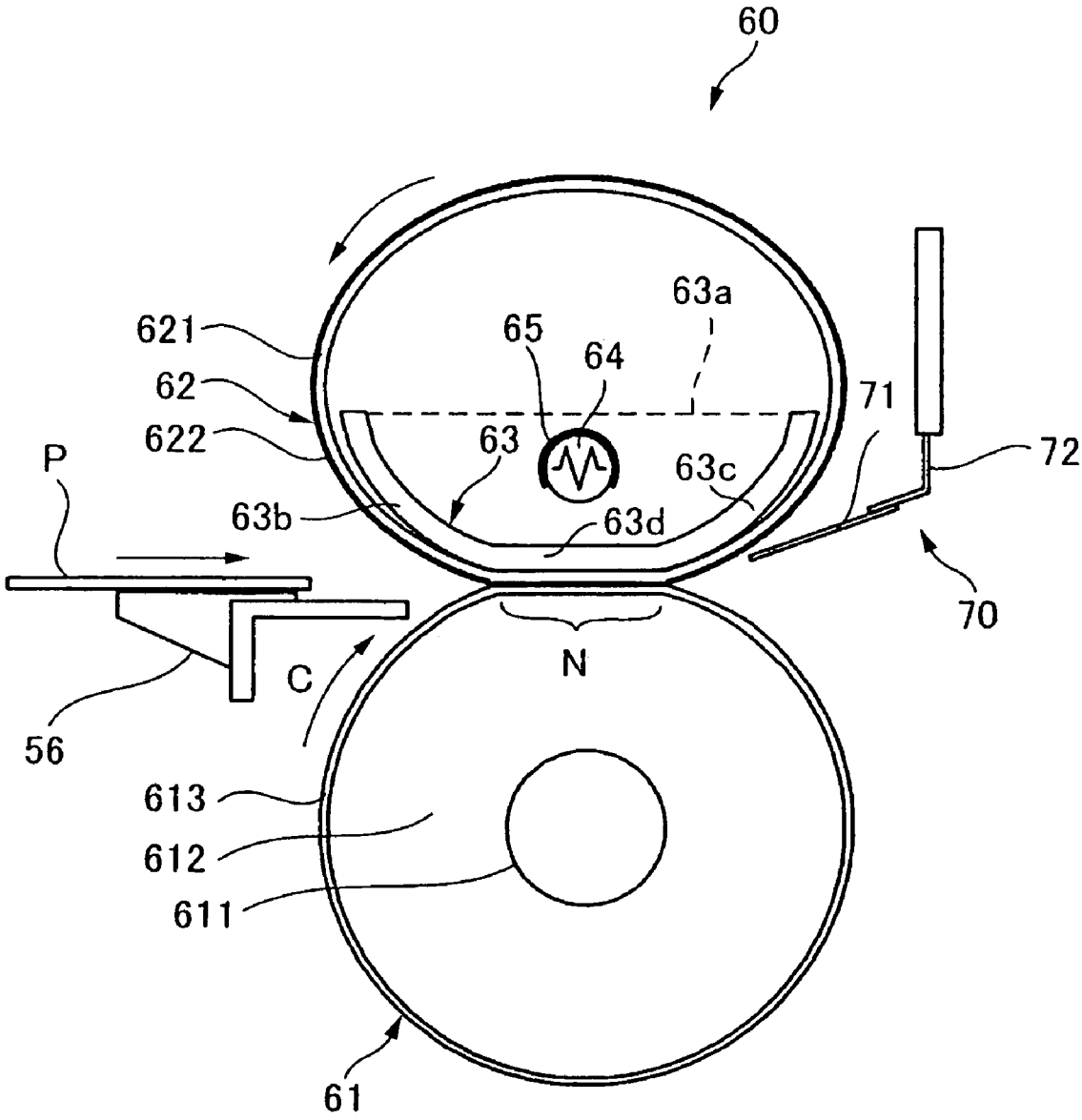
FIG. 2 is a side sectional view showing the configuration of a fixing device according to an embodiment of the present invention.

FIG. 2 is a side sectional view showing the configuration of the fixing device 60 according to the present embodiment. As shown in FIG. 2, the fixing device 60 of the present embodiment includes, as its essential parts, a pressing roller 61 as an example of a pressing member, a fixing belt 62 as a belt member disposed at a toner-image carrying side of a paper P, a belt guide member 63 as an example of a support member which supports an inner peripheral surface of the fixing belt 62 and is pushed from the pressing roller 61 with the fixing belt 62 therebetween, and a halogen heater 64 as a heating member which is disposed within the fixing belt 62 to heat the fixing belt 62.

The pressing roller 61 is disposed to be parallel to the fixing belt 62 and is set to push the fixing belt 62. Also, the pressing roller is adapted to rotate in the direction indicated by the arrow C by a driving motor (not shown) and to rotate the fixing belt 62 following the pressing roller 61 with a frictional force between the fixing belt 62 and the pressing roller 61.

Here, the pressing roller 61 is configured such that a core bar (cylindrical core bar) 611 serving as both a support and a rotating shaft, a heat-resistant elastic layer 612 coated on an outer peripheral surface of the core bar 611, and a releasable layer 613 coated with heat resistant resin or heat-resistant rubber are laminated.

The fixing belt 62 is also an endless belt of which original shape is formed in a cylindrical shape, and is composed of a base layer 621 containing thermosetting polyimide resin, thermoplastic polyimide resin, polyimide resin, polybenzoimidazole resin, or the like, as principal components, and a release layer 622 coated on a surface (an outer peripheral surface) of the base layer at the pressing roller 61, and made of fluorocarbon resin such as PFA (tetrafluoroethyleneperfluoroalkylvinylether copolymers) having excellent releasability and durability. The thickness of the base layer 621 is 40 to 80 μm, and the thickness of the release layer 622 is set to 1 to 30 μm. Here, since, for example, carbon black is mixed in the base layer 621, the fixing belt 62 easily absorbs radiation heat from the halogen heater 64, thereby improving the use efficiency of heat. Accordingly, the base layer 621 also has a function as a heat absorption layer. Incidentally, a configuration in which a heat absorption layer formed by mixing carbon black with PFA without mixing carbon black in the base layer 621 is coated on an inner peripheral surface of the base layer 621 separately from the base layer 621 can be used.

Figure 3:
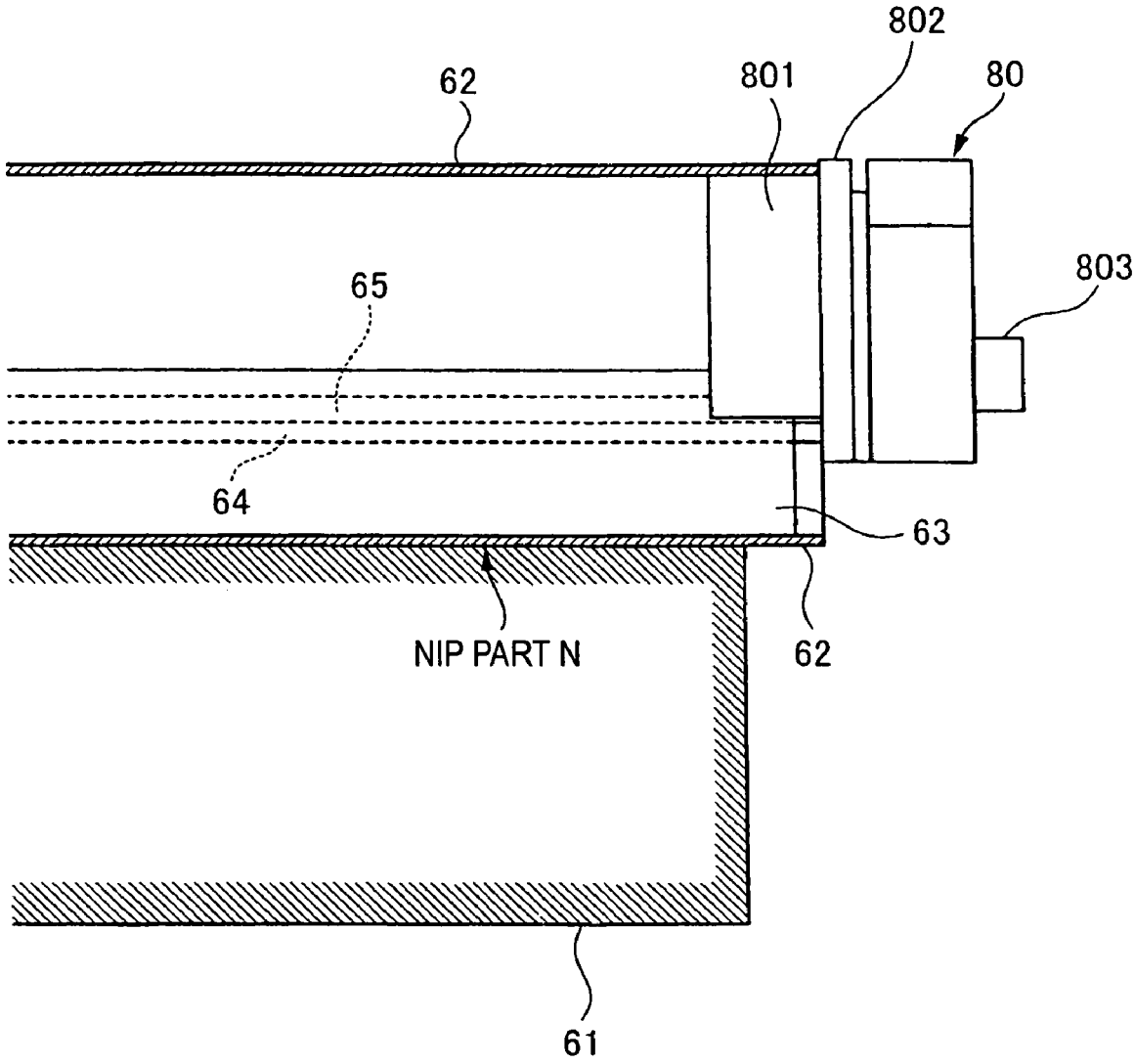
FIG. 3 is a diagram illustrating a configuration that supports ends of a fixing belt.

The fixing belt 62 having such a configuration is rotatably supported by means of the belt guide member 63 disposed within the fixing belt 62 and the edge guide member 80 disposed at both ends of the fixing belt 62 (see FIG. 3).

The configuration of the edge guide member 80 which supports both ends of the fixing belt 62 in its width direction will now be described. FIG. 3 is a diagram illustrating the configuration that supports ends of the fixing belt 62, and shows one end area of the fixing device 60 as seen from the downstream side in a transporting direction of a paper P.

As shown in FIG. 3, the both ends of the fixing belt 62 in its width direction is supported by the edge guide member 80 fixed to both ends of the belt guide member 63 disposed within the fixing belt 62. The edge guide member 80 is composed of a belt running guide part 801 which is formed in a cylindrical shape, that is, in the shape of the letter "C" in section which is notched at its portion corresponding to a nip part N and its vicinity, a flange part 802 which is provided outside the belt running guide part 801 and is formed to have a larger external diameter than the fixing belt 62, and a holding part 803 which is provided on the outside surface of the edge guide member 80 to position the edge guide member 80 in a main body of the fixing device 60 and fix the edge guide member therein.

In the edge guide member 80 of the present embodiment, the outer peripheral surface of the belt running guide part 801 supports a portion of the inner peripheral surface of the both ends of the fixing belt 62 in its width direction. The both ends of the fixing belt 62 rotate while being supported by a portion of the outer peripheral surface of the belt running guide part 801. At this time, a so-called belt walk sometimes occurs that a force (thrust force) is applied to the fixing belt 62 in its width direction to bias the fixing belt in the direction of any one of its both ends. In that case, the belt walk of the fixing belt 62 is limited by the flange part 802 of the edge guide member 80 to regulate occurrence of the bias in the fixing belt 62.

Further, the flange part 802 of the edge guide member 80 supports the both ends of the belt guide member 63 at its facing inside surface as described above, also supports the both ends of the halogen heater 64, and fixedly disposes the halogen heater 64 at a predetermined position within the fixing belt 62.

Next, as shown in FIG. 2, the belt guide member 63 is disposed within the fixing belt 62 to support approximately half of the inner peripheral surface of the fixing belt 62 at the pressing roller 61. Specifically, the belt guide member 63 is formed in the shape of a substantially semi-elliptical barrel (a half-pipe shape). Also, the belt guide member is opened in its area opposite to its side where the pressing roller 61 is disposed, and is formed so as to be curved toward the pressing roller 61. Further, with respect the transporting direction of the paper P, the belt guide member 63 has a curved portion (upstream curved portion) 63*b* formed upstream of the nip part N, and a curved portion (downstream curved portion) 63*c* formed downstream of the nip part N. Moreover, in the fixing device 60 according to the present embodiment, the upstream curved portion 63*b* and the downstream curved portion 63*c* of the belt guide member 63 are formed to be symmetrical with respect to the nip part N. The thus formed belt guide member 63 is disposed within the fixing belt 62 whereby the belt guide member supports the fixing belt 62 while deforming the sectional shape of the fixing belt 62 into a substantially elliptical shape that has a major axis (long diameter) in the transporting direction of a paper P and a minor axis (short diameter) in a direction orthogonal to the transporting direction of a paper P.

The belt guide member 63 disposed inside the fixing belt 62 also has a function of receiving radiation heat from the halogen heater 64 to be heated, and transferring the heat to the fixing belt 62 to heat the fixing belt 62. Further, when the fixing belt 62 is pushed from the pressing roller 61, the belt guide member also has a function of supporting the fixing belt 62 from its inside against a pushing force from the pressing roller 61. Therefore, the belt guide member 63 is formed of a material having high thermal conductance and excellent mechanical strength and rigidity, such as aluminum, iron, and SUS so that the heat radiation from the halogen heater 64 is efficiently transferred to the fixing belt 62, and deflection is not caused against the pushing force from the pressing roller 61.

Moreover, the inner peripheral surface around an area corresponding to the nip part N of the belt guide member 63 is subjected to blackening treatment. This enables the region around corresponding to the nip part N of the belt guide member 63 to efficiently absorb radiation heat from the halogen heater 64.

In addition, the outer peripheral surface of the belt guide member 63 where the belt guide member 63 slides on the fixing belt 62 is desirably coated with a material having a small coefficient of friction and having wear resistance and heat resistance in order to reduce sliding resistance between the belt guide member and the fixing belt 62. Specifically, a Teflon (registered trademark) sheet, a fluorocarbon resin sheet, a fluorocarbon resin coated film, etc can be used.

Further, in order to further reduce sliding resistance between the belt guide member 63 and the fixing belt 62, it is also effective that lubricant such as amino-transformed silicon oil is applied onto the inner peripheral surface of the fixing belt 62.

Next, the halogen heater 64 is a heating source whose rated output is set to 500 to 1000 W. Also, the halogen heater 64 is disposed in an inner area of the curved belt guide member 63. Specifically, the halogen heater 64 is disposed above a middle portion of the nip part N in the transporting direction of a paper N and is disposed about 7 mm closer to the pressing roller 61 (belt guide member 63) than an aperture surface 63*a* (see FIG. 2) of the belt guide member 63. Also, the halogen heater 64 heats the belt guide member 63 around mainly the nip part N in the vicinity of the belt guide member 63.

Further, a surface of the halogen heater 64 opposite to its surface at the nip part N is coated with a semireflective film 65 made of white ceramic for reflecting a portion of the radiation heat from a lamp filament of the halogen heater 64. The semireflective film 65 is set so as to reflect several 10% of radiation heat from the lamp filament of the halogen heater 64 is used. In the fixing device 60 of the present embodiment, a semireflective film 65 that reflects about 60% heat amount of the total calorific value of the halogen heater 64. By constructing the halogen heater 64 as such, in the surface of the halogen heater which is not coated with the semireflective film 65 and located on the side of the nip part N, radiation heat from the lamp filament of the halogen heater 64 heats the belt guide member 63 around the nip part N, and the fixing belt 62 is indirectly heated by thermal conduction from the heated belt guide member 63. On the other hand, in the surface of the halogen heater which is coated with the semireflective film 65 and located opposite to the nip part N, only a portion (about 40% of the total calorific value) of the radiation heat from the semireflective film 65 is transmitted, and the fixing belt 62 is directly heated by the transmitted radiation heat. In this way, the fixing belt 62 is heated to a predetermined temperature in a short time by the halogen heater 64.

Here, in the semireflective film 65 coated on the halogen heater 64, the amount of coating of white ceramic is adjusted so that a predetermined temperature rising rate in portions of the fixing belt 62 and the belt guide member 63 around nip part N can be obtained. The amount of coating of white ceramic is set optimally so that the portions of the fixing belt 62 and the belt guide member 63 around the nip part N are heated at a predetermined temperature rising rate corresponding to a material that forms the belt guide member 63, the thickness of the material, heat capacity, the rated output of the halogen heater 64, and the like.

Further, the semireflective film 65 coated on the halogen heater 64 is coated in an area where its central angle becomes 180 to 270° about the central axis of the halogen heater 64. By coating such an area, the halogen heater 64 positively heats the area (corresponding to the nip part N) of the belt guide member 63, to suppress that an area other than the area corresponding to the nip part N of the belt guide member 63 is excessively heated, or the heat amount by which the fixing belt 62 is directly heated becomes excessive. Therefore, the heat from the halogen heater 64 can be efficiently used, and the fixing belt 62 can be kept from being thermally damaged.

Also, in the fixing device 60 of the present embodiment configured as such, a paper P having a toner image electrostatically transferred thereto in the transfer part 15 of the image forming apparatus shown in FIG. 1, is guided to the nip part N of the fixing device 60 by the fixation inlet guide 56. When the paper P passes through the nip part N, the toner image on the paper p is fixed by the pressure acting on the nip part N and the heat supplied from the fixing belt 62.

The paper which has passed through the nip part N after completion of the fixing processing is peeled off from the fixing belt 62 by a change in the curvature of the fixing belt 62 in an outlet area of the nip part N and then transported a discharged sheet placing part provided in the discharge part of the image forming apparatus. At this time, as an auxiliary unit for completely separating the paper P after the fixation from the fixing belt 62, a peeling-assisting member 70 may be disposed downstream of the nip part N of the fixing belt 62. The peeling-assisting member 70 is held by a baffle holder 72 in a state in which a peeling baffle 71 is close to the fixing belt 62 in a direction (counter direction) opposite to the rotation direction of the fixing belt 62.

Here, in the fixing device 60 of the present embodiment, as described above, the belt guide member 63 disposed within the fixing belt 62 deforms the sectional shape of the fixing belt 62 into a substantially elliptical shape that has a major axis (long diameter) in the transporting direction of a paper P and a minor axis (short diameter) in a direction orthogonal to the transporting direction of a paper P. Also, the pressing roller 61 is disposed in pressure contact with the surface of the fixing belt 62 (the surface intersecting a direction of the short diameter) orthogonal to the minor axis. In this way, by deforming the fixing belt 62 into a flat, substantially elliptical shape which is long in the transporting direction of a paper P, and by bringing the pressing roller 61 into pressure contact with the surface of the fixing belt 62 orthogonal to the minor axis, the fixing belt 62 can be formed to have a small curvature (have a large radius of curvature) at its surface abutting on the pressing roller 61.

Therefore, even if the diameter of the fixing belt 62 is made small, the nip part N where the pressing roller 61 abuts on the fixing belt 62 can be set to have a large width. That is, since the fixing belt 62 abut on the pressing roller 61 in an area where its radius of curvature is large, the area that the fixing belt 62 abuts on the pressing roller 61 can be set large. Accordingly, since the amount of heat enough to melt a toner image can be imparted to the paper P while the paper P passes through the nip part N, good fixing performance can be maintained even when the processing speed of the image forming apparatus using the fixing belt 62 having a reduced diameter is increased.

Further, since the width of the nip part N is set large, the time that the fixing belt 62 comes in contact with the belt guide member 63 can also be increased. Therefore, since heat is rapidly replenished from the belt guide member 63 to the fixing belt 62 which has a lowered temperature by conduction of heat from the fixing belt 62 to a paper P, the temperature of the fixing belt 62 can also be easily kept approximately constant.

In this case, a surface of the belt guide member 63 which is pushed against the pressing roller 61 with the fixing belt 62 therebetween can also be formed of a substantially planar portion 63*d* (see FIG. 2) with a width of, for example, 8 to 9 mm along the transporting direction of a paper P. By constructing the belt guide member 63 in this way, in the nip part N which has an enlarged width due to deformation of the fixing belt 62 into a substantially elliptical shape, a path through which a paper P passes can be formed in the shape of a substantially flat surface. By forming the nip part N of a planar surface, a nip pressure that is uniform and sufficient over the entire area of the widened nip part N can be applied to a paper P passing through the nip part N. Accordingly, since a paper P can be transported at the same speed as the fixing belt 62 in the nip part N, even a recording paper, such as an envelope formed by overlapping of papers P, occurrence of paper wrinkle or curling can be suppressed.

As described above, in the fixing device 60 of the present embodiment, the fixing belt 62 is formed in a substantially elliptical shape that has a major axis in the transporting direction of a paper P and a minor axis in a direction orthogonal to the transporting direction of a paper P by the belt guide member 63 disposed within the fixing belt 62. Also, the pressing roller 61 is disposed in pressure contact with the surface of the fixing belt 62 (the surface intersecting a direction of the short diameter) orthogonal to the minor axis. Therefore, even when the diameter of the fixing belt 62 is made small, the width of the nip part N where the pressing roller 61 abuts on the fixing belt 62 can be set large. Accordingly, since the amount of heat enough to melt a toner image can be imparted to a paper P while the paper P passes through the nip part N, good fixing performance can be maintained even when the processing speed of the image forming apparatus is increased.

Further, the diameter of the fixing belt 62 can be made small to reduce the heat capacity of the fixing belt 62. Therefore, since the temperature of the whole fixing belt 62 can be raised to a fixable temperature with a small amount of heat, the warm-up time can also be shorted simultaneously.

Figure 4A:
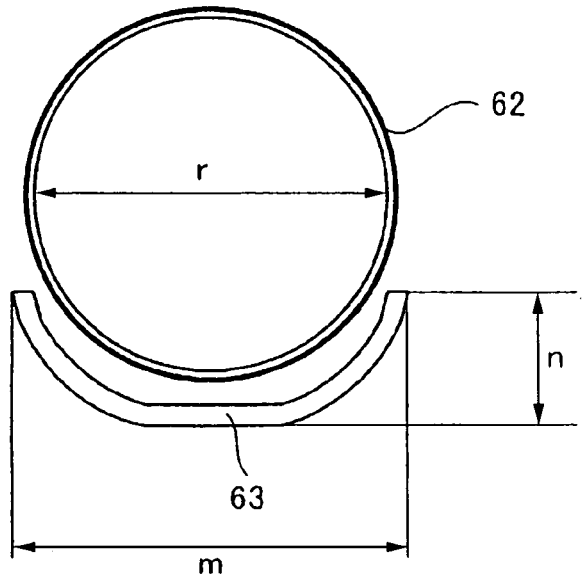
FIGS. 4A and 4B show the relation in size between the fixing belt and a belt guide member.
Figure 4B:
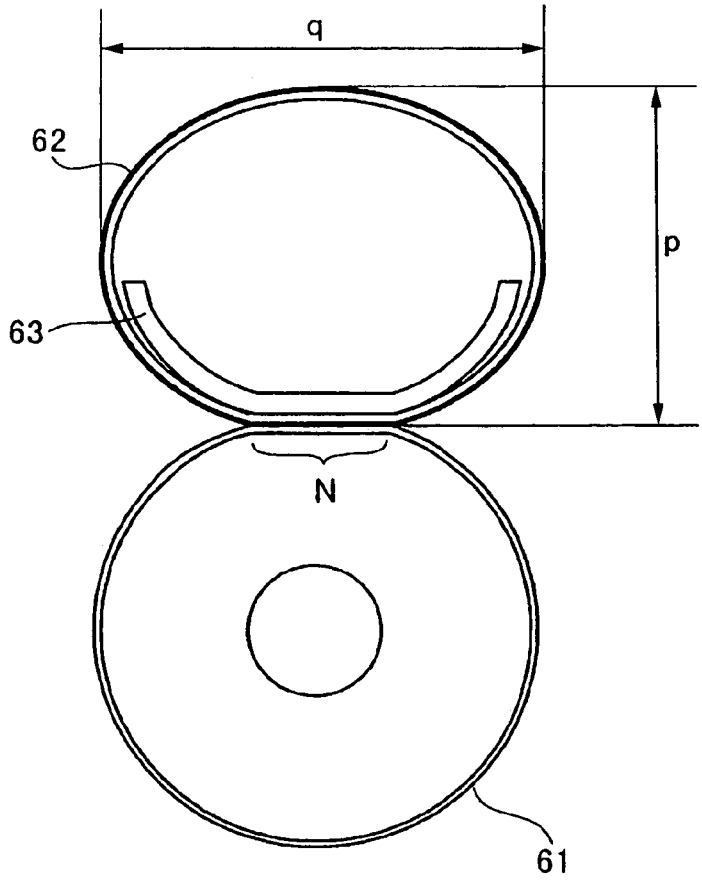

A method of forming a wide nip part N by using a fixing belt 62 with a small diameter will now be described. FIGS. 4A and 4B show the relation in size between the fixing belt 62 and the belt guide member 63. Here, FIG. 4A shows a state before the belt guide member 63 is disposed within the fixing belt 62, and FIG. 4B shows a state after the belt guide member 63 is disposed within the fixing belt 62.

As shown in FIG. 4A, the fixing belt 62 has its original shape that is, for example, a cylinder with a diameter (r) of 30 mm. In contrast, the belt guide member 63 is a semi-elliptical cylinder having a major axis (indicated by "m" in the drawing) of 33 mm and a minor axis (indicated by "n" in the drawing) of 14 mm. That is, the major axis of the belt guide member 63 (its length along the transporting direction of a paper P) is formed to have a larger diameter than the fixing belt 62 formed of a cylinder (original shape). When such a belt guide member 63 is disposed within the fixing belt 62, as shown in FIG. 4B, the sectional shape of the fixing belt 62 can be deformed into a substantially elliptical shape, which is long in the transverse direction in the drawing and short in the longitudinal direction, by the belt guide member 63.

Specifically, when the fixing belt 62 whose original shape is a cylinder with a diameter of r=30 mm, and the belt guide member 63 having a smaller major axis (for example, 28 mm) than the diameter of the original shape is disposed within the fixing belt, the sectional shape of the fixing belt 62 is maintained in a substantially circular shape. At this time, the pressing roller 61 is brought into pressure contact with the fixing belt whereby the maximum width of the nip between the fixing belt 62 and the pressing roller 61 becomes about 8.5 mm. In contrast, as in the fixing device 60 of the present embodiment, when a belt guide member 63 formed of a semi-elliptical cylinder with a section having a major axis m=33 mm and a minor axis n=14 mm is disposed within the fixing belt 62 with a cylinder having a diameter r=30 mm as the original shape, as shown in FIG. 4B, the fixing belt 62 is deformed into an elliptical shape that has a major axis (indicated by "q" in the drawing) of 33 mm and a minor axis (indicated by "p" in the drawing) of 26.5 mm. Also, in this state, the fixing belt is brought into pressure contact with the pressing roller 61 so that the maximum width of the nip between the fixing belt 62 and the pressing roller 61 can be increased to about 13 mm.

By disposing the semi-elliptical cylinder having a larger major axis than the diameter of the original shape of the fixing belt 62 within the fixing belt 62 in this way, the fixing belt 62 can be deformed into a substantially elliptical shape, which is long in the transverse direction in the drawing and short in the longitudinal direction, by the belt guide member 63. As a result, even when a fixing belt 62 having a smaller diameter is used, the maximum width the nip between the fixing belt and the pressing roller 61 can be set greatly large.

As described hitherto, in the fixing device 60 of the present embodiment, the fixing belt 62 is deformed into a substantially elliptical shape, which has a major axis in the transporting direction of a paper P and a short axis in a direction orthogonal to the transporting direction of a paper P, by the belt guide member 63 disposed within the fixing belt 62. Also, the pressing roller 61 is disposed in pressure contact with the surface of the fixing belt 62 (the surface intersecting a direction of the short diameter) orthogonal to the minor axis. Therefore, even if the diameter of the fixing belt 62 is made small, the nip part N where the pressing roller 61 abuts on the fixing belt 62 can be set to have a large width. Accordingly, since the amount of heat enough to melt a toner image can be imparted to the paper P while the paper P passes through the nip part N, good fixing performance can be maintained even when the processing speed of the image forming apparatus using the fixing belt having a reduced diameter is increased.

Further, in the fixing device 60 of the present embodiment, since a fixing belt 62 having a smaller diameter can be used, the heat capacity of the fixing belt 62 can be reduced. Therefore, since the temperature of the whole fixing belt 62 can be raised to a fixable temperature with a small amount of heat, the warm-up time can also be shorted simultaneously.

Embodiment 2

Embodiment 1 has been described about the fixing device 60 which is configured such that the belt guide member 63 formed so as to be symmetrical with respect to the nip part N on the upstream and downstream sides in the transporting direction of a paper P is used, and the belt guide member 63 supports the fixing belt 62 from inside to deform the section of the fixing belt 62 into an elliptical shape. Embodiment 2 will now be described about a fixing device 90 in which a belt guide member 63 formed so as to be asymmetrical with respect to the nip part N on the upstream and downstream sides in the transporting direction of a paper P is used, and the belt guide member 63 supports the fixing belt 62 from inside to deform the section of the fixing belt 62 into a substantially elliptical shape, but a modified shape that is made the curvatures of an upstream curved portion and the curvature of a downstream curved portion different from each other. Incidentally, elements similar to those in Embodiment 1 are designated by similar numerals, and thus the description thereof will be omitted herein.

Figure 5:
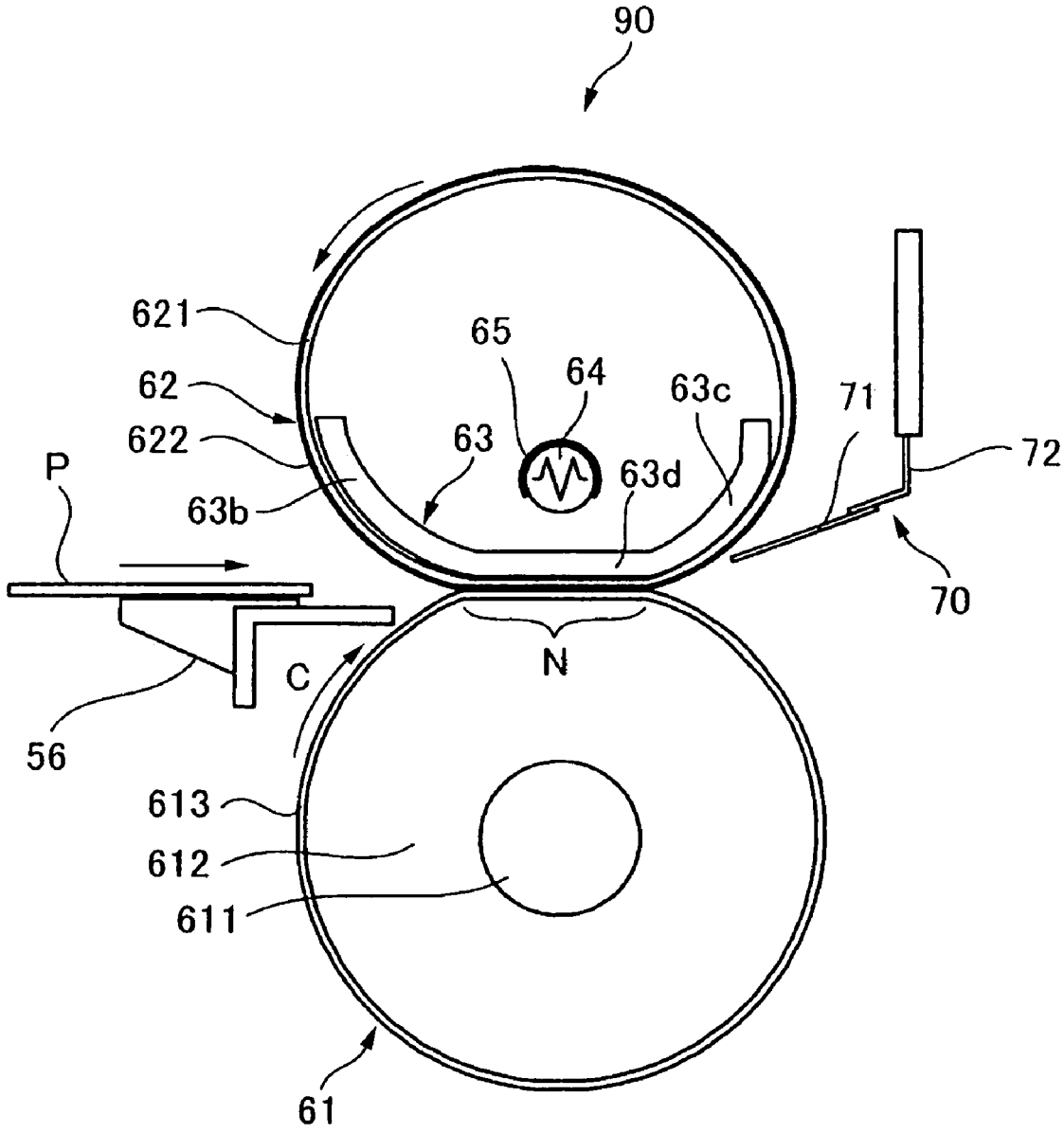
FIG. 5 is a side sectional view showing the configuration of a fixing device according to another embodiment of the invention.

FIG. 5 is a side sectional view showing the configuration of the fixing device 90 according to the present embodiment. As shown in FIG. 5, the fixing device 90 of the present embodiment is the same as the fixing device 60 shown in Embodiment 1 in terms of its basic configuration, but is different from the fixing device 60 in that the belt guide member 63 disposed within the fixing belt 62 to support the fixing belt 62 is formed to be asymmetrical with respect to the nip part N on the upstream and downstream sides in the transporting direction of a paper P. That is, the belt guide member 63 is formed such that the curvature of a curved portion (upstream curved portion) 63*b* formed upstream of the nip part N is small (have a large radius of curvature), whereas the curvature of a curved portion (downstream curved portion) 63*c* formed downstream of the nip part N is large (its radius of curvature is small).

By forming the belt guide member 63 in this way, the fixing belt 62 can be deformed into a substantially elliptical shape that has a smaller curvature (larger radius of curvature) upstream of the nip part N and a larger curvature (smaller radius of curvature) downstream of the nip part N. Therefore, even in the fixing device 90 of the present embodiment, even if the diameter of the fixing belt 62 is made small, the nip part N where the pressing roller 61 abuts on the fixing belt 62 can be set to have a large width. Accordingly, since the amount of heat enough to melt a toner image can be imparted to the paper P while the paper P passes through the nip part N, good fixing performance can be maintained even when the processing speed of the image forming apparatus is increased. Further, since a fixing belt 62 having a smaller diameter can be used, the heat capacity of the fixing belt 62 can be reduced. Therefore, since the temperature of the whole fixing belt 62 can be raised to a fixable temperature with a small amount of heat, the warm-up time can also be shorted simultaneously.

Moreover, in the fixing device 90 of the present embodiment, the fixing belt 62 is set such that its curvature downstream of the nip part N becomes large (its radius of curvature becomes small). This configuration allows a paper P discharged from the nip part N to be easily peeled off from the fixing belt 62.

Specifically, when a paper P passes through the nip part N, a toner image on the paper P receives heat from the fixing belt 62 to enter a melted state. Thus, the paper P is discharged from nip part N in a state stuck on the fixing belt 62 because the toner image acts as a binder. However, in the fixing device 90 of the present embodiment, the traveling direction of the fixing belt 62 which has passed through the nip part N is sharply curved upward by the curved portion 63*c* of the belt guide member 63 formed downstream of the nip part N. Therefore, since the traveling direction of the fixing belt 62 is sharply changed after the paper P transported in a state adhered to the fixing belt 62 in the nip part N has passed through the nip part N, the paper P cannot follow the change in the traveling direction of the fixing belt 62. Accordingly, the paper P in the state adhered to the fixing belt 62 is surely peeled off from the fixing belt 62 by the stiffness of the paper itself.

As described above, even when the process speed of the image forming apparatus in the fixing device 90 of the present embodiment is increased, it is possible to maintain good fixing performance while reducing warm-up time.

As examples which utilize the invention, there are an application to image forming apparatuses, such as copying machines or printers, which use an electrophotographic method, and an application to fixing devices which fix, for example, an unfixed toner image carried on a recording sheet. There are also an application to image forming apparatuses, such as copying machines or printers, which use an inkjet method and an application to fixing devices which dry, for example, an undried ink image carried on a recording sheet.

As described so far, according to an aspect of the invention, a fixing device for fixing a toner image carried on a recording material includes a belt member that rotates in a state where its major axis is set in a transporting direction of the recording material and its minor axis is set in a direction orthogonal to the transporting direction of the recording material; and a pressing member disposed in pressure contact with a surface of the belt member intersecting a direction of the minor axis of the belt member to form a nip part through which the recording material passes.

Here, the fixing device may further include a belt guide member that supports the belt member from inside while maintaining the belt member in a state where the major axis is set in the transporting direction of the recording material and the minor axis is set in the direction orthogonal to the transporting direction of the recording material. In particular, the belt guide member may support the surface of the belt member at least in the nip part. Further, the fixing device may further include a heating member that heats an area of the belt guide member corresponding to the nip part. Moreover, the belt guide member may have an upstream curved portion formed upstream of the nip part in the transporting direction of the recording material, and a downstream curved portion formed downstream of the nip part in the transporting direction of the recording material. The upstream and downstream curved portions may be formed so as to be curved toward the pressing member.

Further, according to another aspect of the invention, a fixing device for fixing a toner image carried on a recording material includes a rotatable belt member; a belt guide member that deforms the section of the belt member into a substantially elliptical shape, and supports the deformed belt member from inside; and a pressing member that is disposed in pressure contact with a surface of the belt member intersecting a direction of the minor axis of the belt member deformed by the belt guide member to form a nip part through which the recording material passes.

Here, the belt guide member may be formed such that its length along a transporting direction of the recording material is larger than the diameter of the belt member when the belt member is formed of a cylinder. Further, the belt guide member may be formed so as to be curved toward the pressing member, and support an area of the belt member including the nip part from inside. In this case, the belt guide member may be formed of a plane in its area corresponding to the nip part. Further, the belt guide member may have an upstream curved portion formed upstream of the nip part in the transporting direction of the recording material and a downstream curved portion formed downstream of the nip part, and the radius of curvature of the downstream curved portion may be formed to be smaller than the radius of curvature of the upstream curved portion.

Moreover, the belt guide member may be formed such that its surface opposite to the pressing member is open. Further, the fixing device may further include a heating member that heats the belt guide member in the vicinity of the area of the belt guide member corresponding to the nip part. In this case, the belt guide member may be formed such that its surface opposite to the pressing member is open, and the heating member may be formed with a semireflective film which limits a portion of the amount of heat radiated toward the side opposite to the pressing member.

Moreover, according to still another aspect of the invention, an image forming apparatus includes: a toner image forming unit that forms a toner image; a transfer unit that transfers the toner image formed by the toner image forming unit onto a recording material, and a fixing unit that fixes the toner image transferred onto the recording material on the recording material. The fixing unit have a belt member that rotates in a state where its major axis is set in a transporting direction of the recording material and its minor axis is set in a direction orthogonal to the transporting direction of the recording material; a pressing member disposed in pressure contact with a surface of the belt member intersecting a direction of the minor axis of the belt member to form a nip part through which the recording material passes, and a belt guide member that supports the belt member from inside while maintaining the belt member in a state where the major axis is set in the transporting direction of the recording material and the minor axis is set in the direction orthogonal to the transporting direction of the recording material.

According to the invention, both shortening of warm-up time and speed-up of the image forming apparatuses can be realized.

The entire disclosure of Japanese Patent Application No. 2005-034700 filed on Feb. 10, 2005 including specification, claims, drawings and abstract is incorporated herein by reference in its entirety.

What is claimed is:

1. A fixing device for fixing a toner image carried on a recording material, comprising:

an elliptically-shaped belt member that rotates in a state where its major axis is set in a transporting direction of the recording material and its minor axis is set in a direction orthogonal to the transporting direction of the recording material;

a belt guide member contacting an inner surface of the belt member having an outer surface formed in a horizontal plane at an area corresponding to a nip part; and a pressing member disposed in pressure contact with a surface of the belt member intersecting a direction of the minor axis of the belt member to form the nip part through which the recording material passes, wherein;

the main axis of the belt member is longer than the minor axis of the belt member; and wherein the belt member is formed in the horizontal plane at the area corresponding to the nip part; and wherein the belt guide member has an upstream curved portion formed upstream of the nip part in the transporting direction of the recording material and a downstream curved portion formed downstream of the nip part, and a radius of curvature of the downstream curved portion is formed to be smaller than a radius of curvature of the upstream curved portion.

2. The fixing device according to claim 1, wherein the belt guide member is made of a material having excellent thermal conductance, mechanical strength, and rigidity.

3. The fixing device according to claim 1, wherein the belt guide member is made of any one of aluminum, iron, and SUS.

4. The fixing device according to claim 1, further comprising a heating member that heats an area of the belt guide member corresponding to the nip part.

5. The fixing device according to claim 1, wherein the belt guide member has an upstream curved portion formed upstream of the nip part in the transporting direction of the recording material, and a downstream curved portion formed downstream of the nip part in the transporting direction of the recording material, the upstream and downstream curved portions being formed so that the belt guide member is curved toward the pressing member in its entirety.

6. A fixing device for fixing a toner image carried on a recording material, comprising a rotatable belt member;

a belt guide member that deforms the section of the belt member into a substantially elliptical shape, and supports the deformed belt member from inside; and a pressing member that is disposed in pressure contact with a surface of the belt member intersecting a direction of a minor axis of the belt member deformed by the belt guide member to form a nip part through which the recording material passes, wherein;

a main axis of the belt member deformed by the belt guide member is longer than the minor axis of the belt member; and wherein the belt guide member is formed in a horizontal plane at an area corresponding to the nip part; and wherein the belt guide member has an upstream curved portion formed upstream of the nip part in the transporting direction of the recording material and a downstream curved portion formed downstream of the nip part, and a radius of curvature of the downstream curved portion is formed to be smaller than a radius of curvature of the upstream curved portion.

7. The fixing device according to claim 1, wherein the belt guide member is formed such that its length along a transporting direction of the recording material is larger than the diameter of the belt member when the belt member is formed to be cylindrical.

8. The fixing device according to claim 1, wherein the belt guide member is formed to be open at a part opposite to the pressing member.

9. The fixing device according to claim 1, further comprising a heating member that heats the belt guide member in the vicinity of the area of the belt guide member corresponding to the nip part.

10. The fixing device according to claim 1, wherein the belt guide member is formed to be open at a part opposite to the pressing member, and a heating member is formed with a semi-reflective film which reflects a part of heat radiated toward a side opposite to the pressing member.

11. An image forming apparatus comprising:

a toner image forming unit that forms a toner image;

a transfer unit that transfers the toner image formed by the toner image forming unit onto a recording material, and a fixing unit that fixes the toner image transferred onto the recording material on the recording material, the fixing unit including:

a belt member that rotates in a state where its major axis is set in a transporting direction of the recording material and its minor axis is set in the direction orthogonal to the transporting direction of the recording material;

a pressing member disposed in pressure contact with a surface of the belt member intersecting a direction of the minor axis of the belt member to form a nip part through which the recording material passes, and a belt guide member that supports the belt member from inside while maintaining the belt member in a state where the major axis is set in the transporting direction of the recording material and the minor axis is set in the direction orthogonal to the transporting direction of the recording material;

wherein the belt guide member is formed in a horizontal plane at an area corresponding to the nip part, wherein the belt guide member has an upstream curved portion formed upstream of the nip part in the transporting direction of the recording material and a downstream curved portion formed downstream of the nip part, and a radius of curvature of the downstream curved portion is formed to be smaller than a radius of curvature of the upstream curved portion.

* * * * *